United States Patent [19]

Peppers et al.

[11] Patent Number: 4,483,394

[45] Date of Patent: Nov. 20, 1984

[54] HYDRAULIC POWER UNIT FOR MEASUREMENT WHILE DRILLING APPARATUS

[75] Inventors: James M. Peppers; Farhat A. Shaikh, both of Houston, Tex.

[73] Assignee: Dresser Industries, Inc., Dallas, Tex.

[21] Appl. No.: 438,078

[22] Filed: Nov. 1, 1982

[51] Int. Cl.[3] ..... E21B 47/12

[52] U.S. Cl. ..... 166/113; 33/307; 175/40; 175/93

[58] Field of Search ..... 175/40, 45, 50, 93; 166/113; 33/307; 367/85; 340/861

[56] References Cited

U.S. PATENT DOCUMENTS

| | | | |
|---|---|---|---|
| 3,303,573 | 2/1967 | Alder et al. | 33/307 |
| 4,184,545 | 1/1980 | Claycomb | 175/50 |
| 4,235,021 | 11/1980 | Claycomb | 33/307 |
| 4,266,606 | 5/1981 | Stone | 367/85 |
| 4,351,037 | 9/1982 | Scherbatskoy | 175/40 |
| 4,371,958 | 2/1983 | Claycomb | 33/307 |

*Primary Examiner*—George A. Suchfield
*Assistant Examiner*—William P. Neuder
*Attorney, Agent, or Firm*—Richard M. Byron

[57] ABSTRACT

A hydraulic power unit is provided for a downhole instrument of a measurement while drilling system for a well drilling. The hydraulic power unit is enclosed within a drill collar that is connected in the drill string of a rotary drilling rig. An outer body sleeve is rigidly mounted in the instrument drill collar. A fixed inner sleeve is connected to the outer body sleeve in a concentric relation with a longitudinally movable plunger assembly supported therebetween and movable in the telescopic fashion between an extended position and a retracted position to provide hydraulic power fluid for the hydraulically powered circuits of the instrument.

11 Claims, 11 Drawing Figures

HYDRAULIC POWER UNIT FOR MEASUREMENT WHILE DRILLING APPARATUS

TECHNICAL FIELD

This invention is related to well drilling measurement while drilling systems that have a downhole drill string mounted instrument equipped with hydraulically powered mechanisms. The hydraulic power unit of this invention includes a longitudinally, movable plunger assembly that is moved downward by mud or drilling fluid flowing through the drill string to provide a temporary source of hydraulic power fluid for the hydraulic circuits of the instrument.

BACKGROUND OF THE INVENTION

The present invention is directed to the downhole portion of a measurement while drilling instrument that is provided with a hydraulically powered signaling device. This measurement while drilling instrument is operable to provide output signals indicative of at least geometric and geographic orientations of a selected segment of the well borehole. The output signaling device of the particular instrument having this invention is adapted to pulse modulate the mud flowing within the drill string by selectively restricting the mud flow through a lower portion of the instrument as it exits the instrument drill collar. Typically the measurements are desired at the initiation of drilling following the addition of a segment of drilling pipe to the drill string and the instrument is only operated during these periods.

As drilling resumes, the mud pumps at the earth surface are started and the mud pressure within the drill string increases to a nominal operating level. As this occurs the hydraulic circuit powering device of the instrument extracts its operating power from the mud flow through the instrument drill collar and in turn provides the hydraulic power fluid necessary for operating the hydraulic circuits of the instruments mud modulating or signal generating device.

In the prior hydraulic power unit structures for this character of instrument a telescopic piston assembly has been used that combines the formation of a flow restriction necessary for creating the differential driving pressure with the piston structure of the hydraulic reservoir. One structure representative of this is U.S. Pat. No. 4,235,021, issued Nov. 25, 1980. The present invention improves over difficulties of operating the apparatus of this identified patent, namely, for drilling operations in which the mud flow rate is relatively low. In this situation a very significant restriction around the movable plunger apparatus is required in order to provide a sufficient pressure differential for creating the fluid forces necessary to move the plunger assembly downward. This narrow spacing around the plunger assembly causes vibration of the elements involved due to the substantially increased flow rate through the narrow space. The result of this is damaging of the plunger assembly, increased friction and ultimately failure of the plunger assembly. Also, due to the close spacing of the elements involved, the frictional resistance to movement of the plunger assembly within the instrument is substantially increased thereby reducing the operational effectiveness of the hydraulic power unit.

SUMMARY OF THE INVENTION

In an embodiment an improved power unit for the measurement while drilling system is provided that has an outer body sleeve mounted in the instrument drill collar and a fixed inner sleeve connected thereto with a longitudinally movable plunger assembly mounted between these sleeves to form a power fluid reservoir having a variable volume hydraulic chamber. Telescopic motion of the plunger assembly relative to the sleeves reduces this power fluid reservoir and provides hydraulic power fluid for the instrument. A choke is carried by the plunger assembly to produce the pressure differential needed for creation of the force necessary to move the plunger assembly downward.

One object of this invention is to provide a hydraulic power unit for a measurement while drilling downhole instrument that overcomes the aforementioned disadvantages of the prior art devices.

Another object of this invention is to provide an improved hydraulic power unit that operates with substantially less friction than prior art devices and which creates a negligible pressure drop after its operating cycle.

Still, one other object of this invention is to provide an improved hydraulic power unit with an outer body sleeve rigidly mountable in an instrument drill collar with a rigidly mounted fixed inner sleeve connected thereto forming a power fluid reservoir with a variable volume hydraulic chamber that is reduced in volume upon actuation of the instrument for the transmission of data.

Still, another object of this invention is to provide an improved hydraulic power unit for the measurement while drilling instrument that has a temporary occlusion with a readily removable choke element that is replaceable in order to permit operation of the instrument in drilling systems having different or variable mud flow rates through the drill string.

Various other objects, advantages and features of this invention will become apparent to those skilled in the art from the following discussion, taken in conjuntion with the accompanying drawings, in which:

Figures 1, 2:
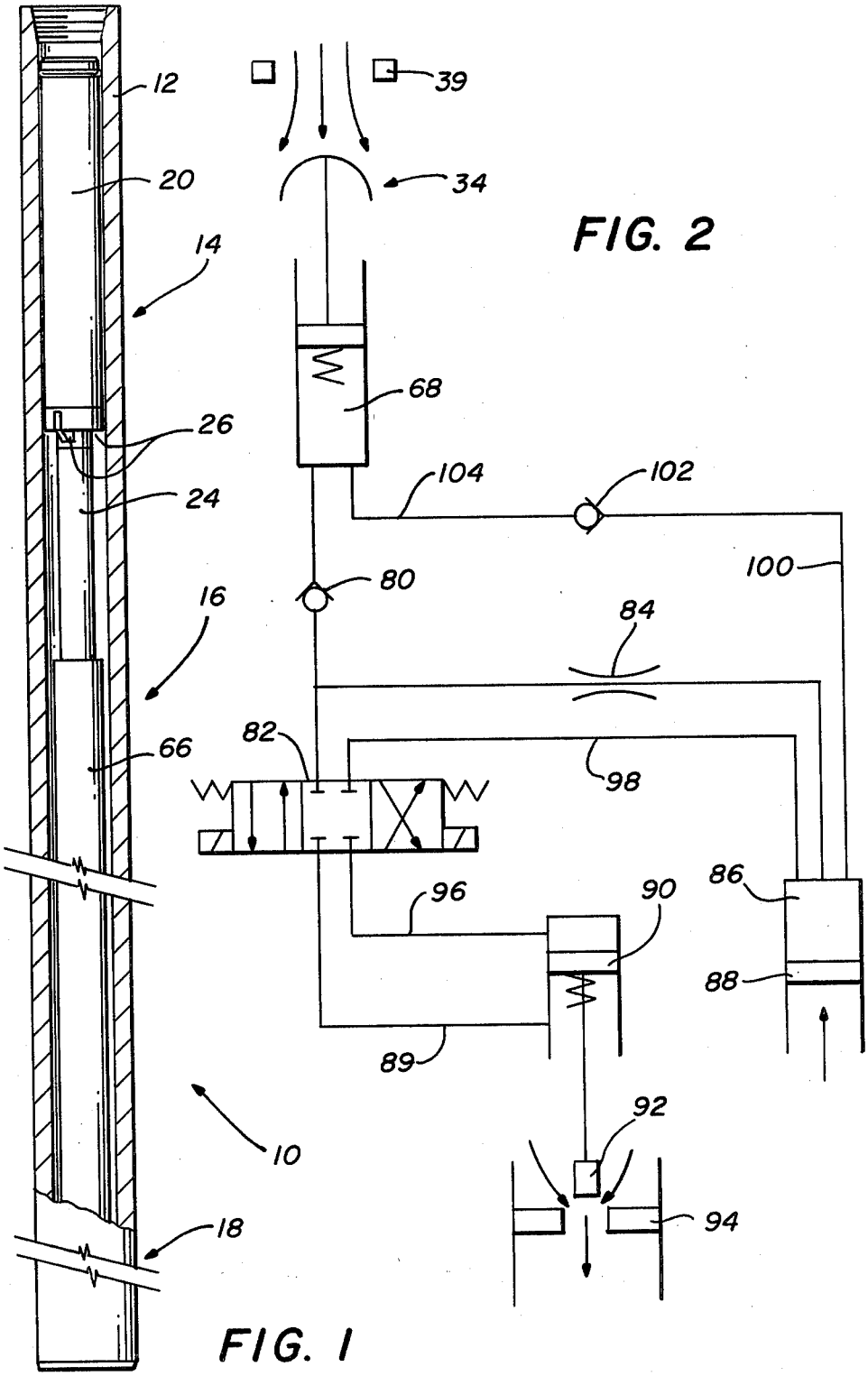
FIG. 1 is a shortened and cutaway view of the instrument carrying drill collar containing the downhole measurement while drilling instrument.
FIG. 2 is a schematic view of the hydraulic circuit of the measurement while drilling instrument illustrating the operational connection of the hydraulic power unit in the hydraulic system.

The following is a discussion and description of preferred specific embodiments of the improved hydraulic unit of this invention, such being made with reference to the drawings, whereupon the same reference numerals are used to indicate the same or similar parts and or structure. It is to be understood that this discussion and description is not to unduly limit the scope of this invention.

DETAILED DESCRIPTION OF THE PREFERRED EMBODIMENT

Referring to the drawings in detail and in particular to FIG. 1 wherein the downhole measurement while drilling instrument assembly with the drill collar is shown in a cutaway view and indicated generally at 10. The instrument itself is contained within a special instrument carrying drill collar 12 that is constructed for mounting in the drill string of an existing rotary drilling type drill string. The downhole instrument is mounted within the passageway of drill collar 12 so that the drilling mud can flow through and around the various portions of the instrument. The measurement while drilling instrument assembly includes an upper portion indicated generally at 14 that contains the hydraulic power unit apparatus of this invention. A mid portion of the instrument, indicated generally at 16, contains the measurement taking portions of the apparatus and other electronic components. The instrument's lower portion, indicated generally at 18, contains a lower hydraulic reservoir and the mud flow modulation device.

Figure 3A:
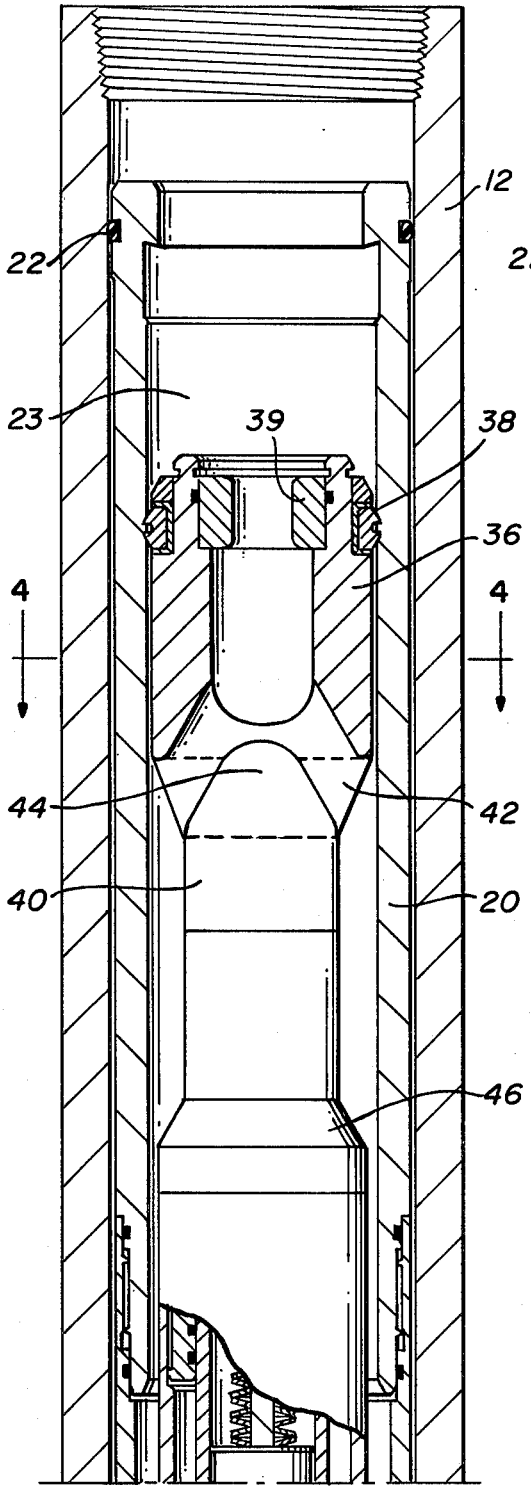
FIG. 3 is a segmented and partially cutaway elevation view of the instrument within the drill collar wherein the hydraulic power unit is illustrated with the plunger assembly thereof in its telescopically extended position.
Figure 5A:
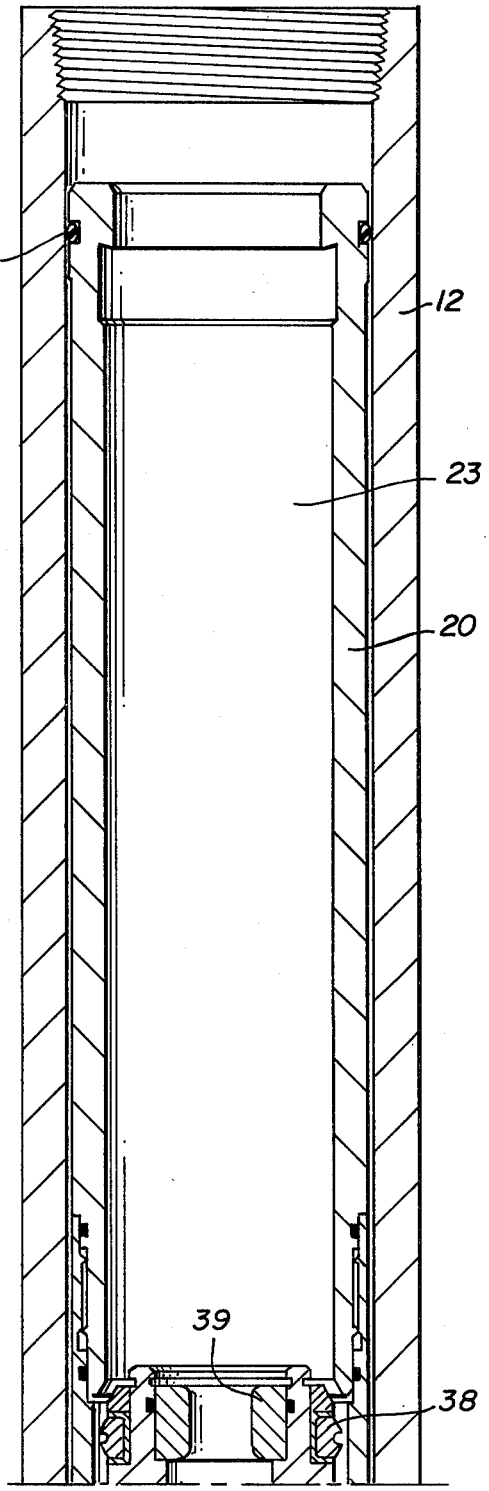
FIG. 5 is a view similar to that of FIG. 3 only with the plunger assembly in its telescopically retracted position.
Figure 3B:
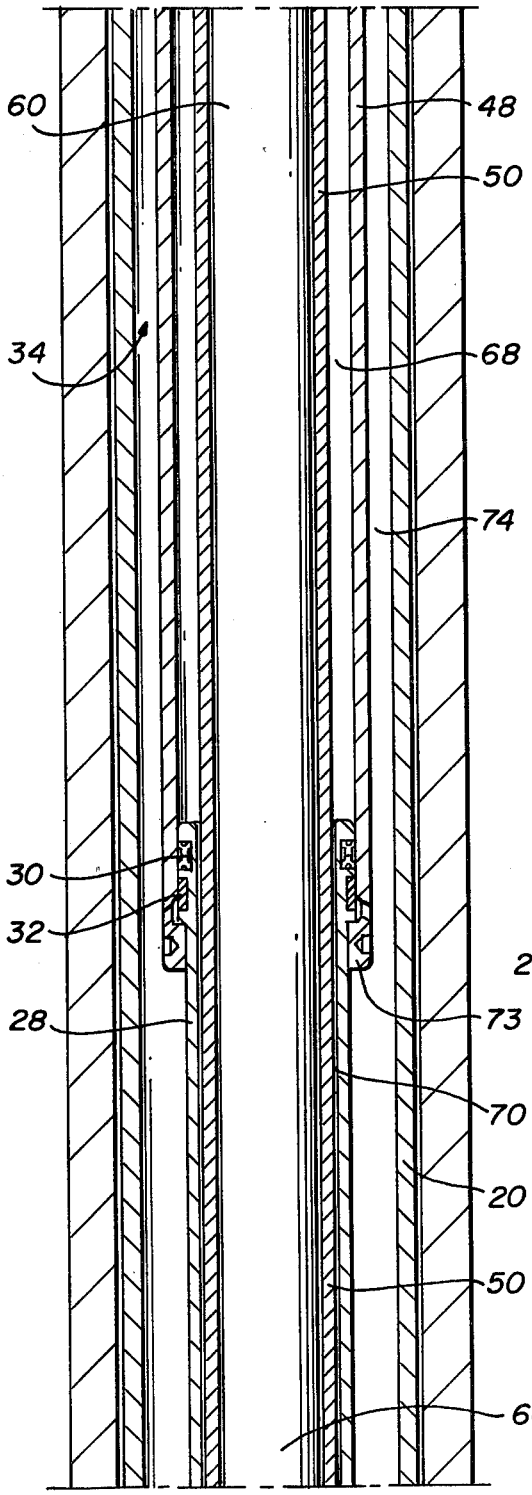
Figure 5B:
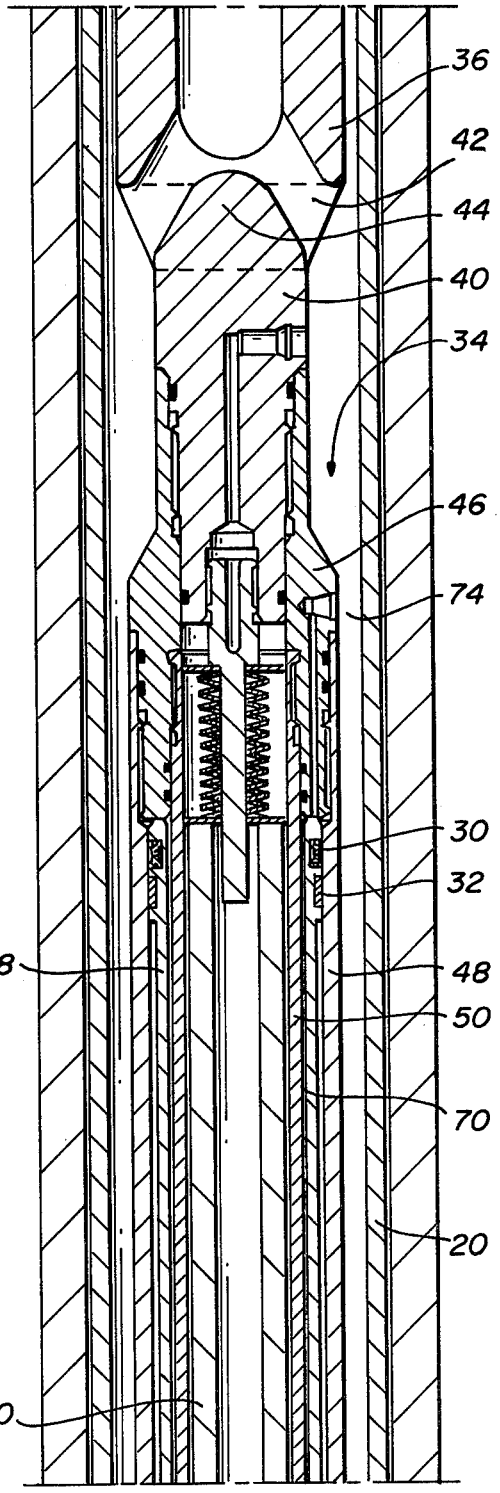
Figure 3C:
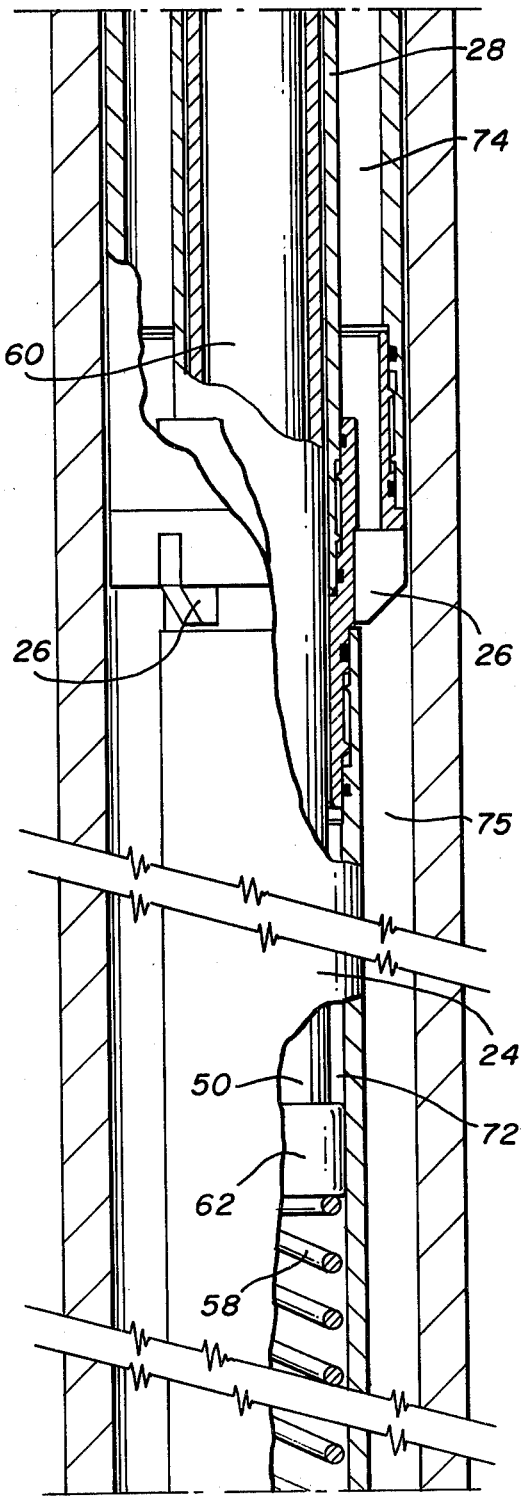
Figure 5C:
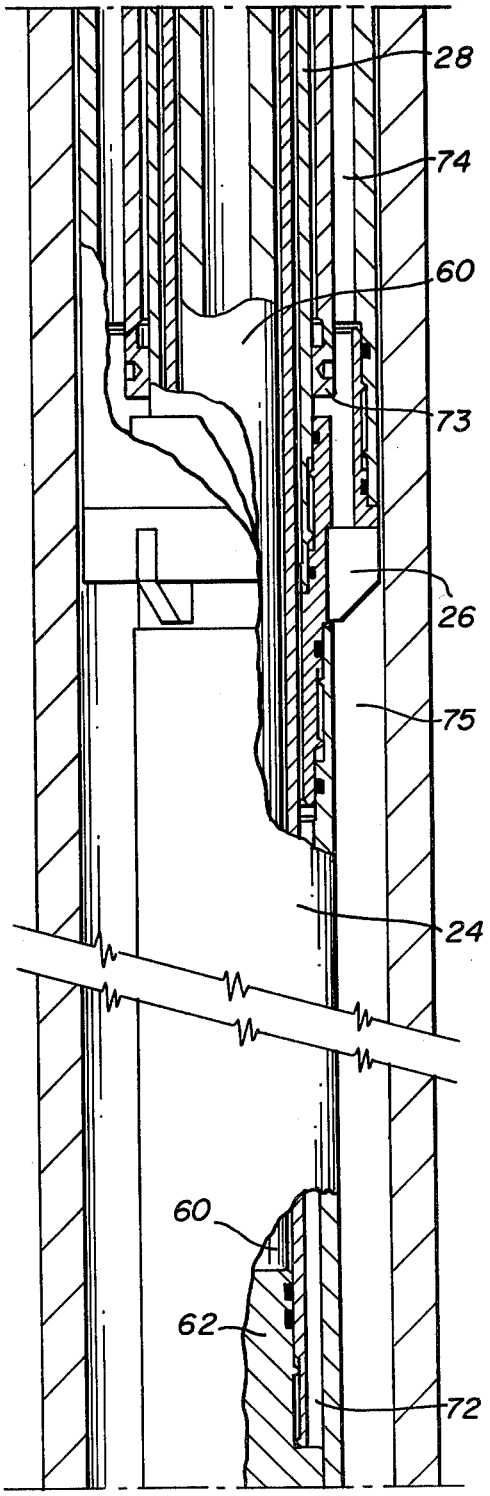
Figure 3D:
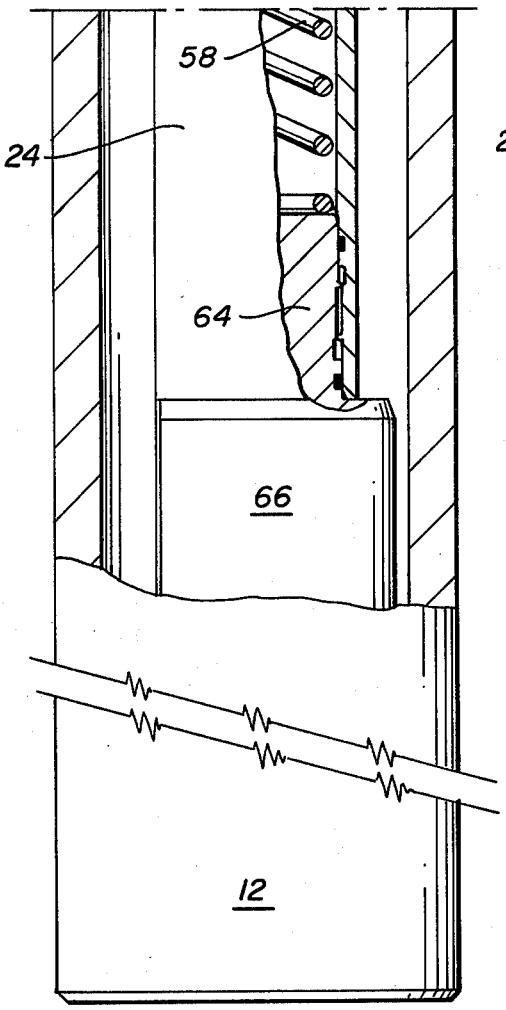
Figure 5D:
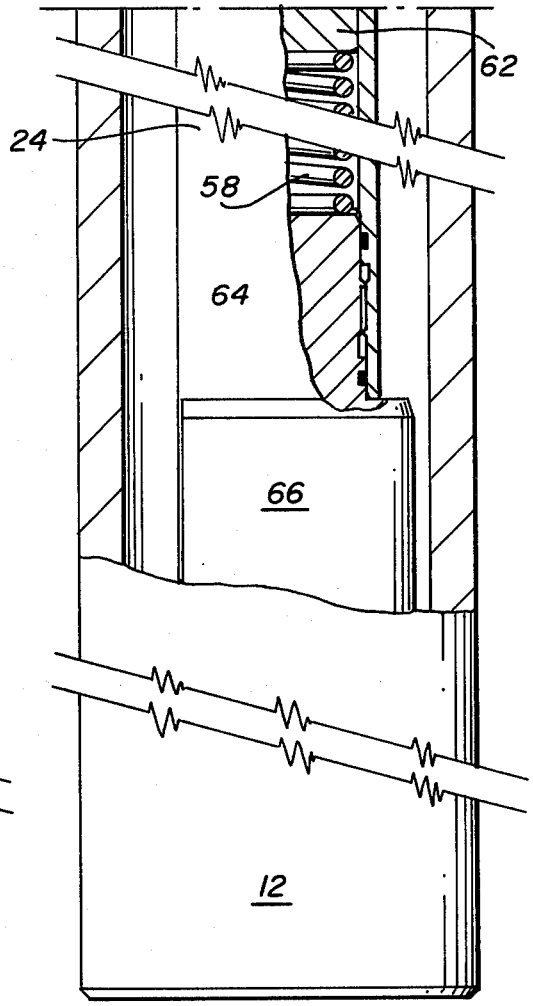

Referrring to FIG. 3, beginning at FIG. 3A and proceeding in sequence thereafter, the improved power unit of this invention is shown in a cutaway sectional view within drill collar 12. The improved power unit is shown with the movable member of the plunger assembly in its extended position which is the position assumed by the instrument when drilling fluid or mud is not flowing through the drill string. The interior of drill collar 12 is a smooth cross sectionally circular bore. At the upper end portion of instrument assembly 10 an outer body sleeve 20 is positioned adjacent to the drill collar bore. An O-ring seal 22 around the upper end portion of outer body sleeve 20 seals between the sleeve and drill collar so that mud flows through the interior of outer body sleeve 20. This outer body sleeve is constructed in several segments with the uppermost segment having a thicker sidewall and a smooth interior surface indicated at 23 through its major portion. This wall section is coated to prevent erosion due to high mud velocity. The lower end of outer body sleeve 20 is secured in a concentric relation to another smaller diameter body sleeve 24 spanning a mid portion of the instrument assembly. A plurality of fin-brace members 26 are mounted between the lower portion of outer body sleeve 20 and to the other body sleeve 24 in a spaced relation so as to concentrically position the sleeves.

Within the interior of outer body sleeve 20 is a fixed inner sleeve 28 extending upward from the upper portion of other body sleeve 24 into a longitudinal mid portion of outer body sleeve 20. Fixed inner sleeve 28 is rigidly mounted to and sealably connected with other body sleeve 24. At the upper end portion of fixed inner sleeve 28 a seal ring 30 and a bearing 32 are provided around the exterior thereof to seal with the interior of another member.

Contained within outer body sleeve 20 is a longitudinally movable plunger assembly, indicated generally at 34. The upper portion of plunger assembly 34 contains a tubular segment 36 with a seal ring 38 mounted therearound in a slidable sealable connection with outer body sleeve interior surface 22. The interior of tubular segment 36 contains a choke ring 39 mounted in a recess within the upper end portion of this tubular segment.

A fluid choke is created by choke ring 39 and tubular segment 36 within the mud flow path to create a pressure differential between the mud above the plunger assembly and the mud alongside and below the plunger assembly. This choke effectively forms an occlusion that creates the downwardly directed fluid force necessary to move plunger assembly 34 in the downward direction. Choke ring 39 can be readily removed from tubular segment 36 and replaced with a ring having a different internal diameter in order to accommodate different mud flow rates through the drill string. The internal diameter of this ring is selected in correspondence with the mud flow rate through the drill string and the force necessary to move plunger assembly 34 in the downward direction.

Figure 4:
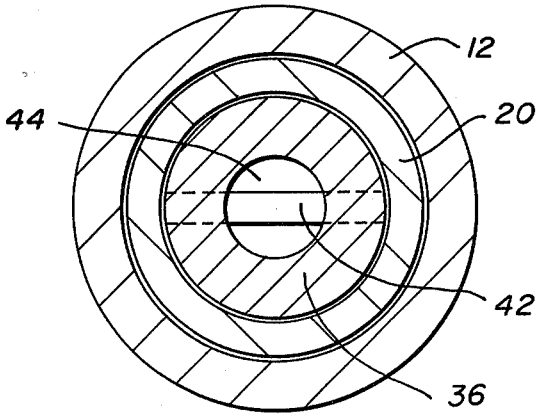
FIG. 4 is a cross sectional view taken through the upper end portion of the complete assembly on line 4—4 of FIG. 3.

Below tubular segment 36 is a mid body segment 40. The connection between tubular segment 36 and mid body segment 40 is accomplished by a transversely disposed vane like supporting member 42 spanning between the interior of tubular segment 36 and the rounded upper end portion 44 of mid body segment 40. Reference is made to FIG. 4 illustrating a sectional view of the instrument taken looking downward from immediately above vane member 42.

Plunger assembly mid body segment 40 forms a support for several downwardly extending elements including a compression spring (not shown in dwg.) which extends the telescopic tube in the extended position. A plunger assembly body coupler 46 is attached to a mid portion of mid body segment 40 and extends downward. This body coupler 40 has a plunger assembly outer sleeve 48 threadedly and sealably secured around its exterior and a plunger assembly inner sleeve 50 also threadedly and sealably mounted around its interior in order to support these two sleeves in a concentric and depending relation.

Within the lower end of other body sleeve 24 the plunger assembly inner sleeve 50 is threadedly and sealably mounted with a plug member 62. The lower end of plug member 62 contacts the upper end portion of a coil spring 58. The outer periphery of plug 62 resides within the interior of other body sleeve 24. As the plunger assembly moves downward plug 62 is likewise moved downward within other body sleeve 24 and compresses extension spring 58. This spring 58 biases the telescopic members of this assembly toward their extended position.

At a lower portion of the instrument other body sleeve 24 is terminated at another pluglike connector member 64 which supports the lower end of compression spring 58. Plug 64 is threadedly and sealably mounted to the interior of other body sleeve 24 and connects this portion of the instrument housing with an enlarged lower housing segment 66. This housing segment 66 contains other apparatus of the measurement while drilling instrument; however, these portions of the instrument are not particularly relevant to the invention and for this reason they will not be described here in detail.

Between plunger assembly outer sleeve 48 and plunger assembly inner sleeve 50 a variable volume hydraulic fluid chamber 68 is formed. This hydraulic chamber 68 forms the uppermost reservoir of the hydraulic system for the instrument and it is the hydraulic power fluid reservoir. This chamber is connected to the hydraulic system of the instrument by an annular hydraulic fluid passageway 70 formed between fixed inner sleeve 28 and the exterior of plunger assembly inner sleeve 50. Annular passageway 70 extends downwardly through the instrument and connects with other portions of the hydraulic circuitry through a series of connecting passageways. One of such passageways is indicated at 72 as an annular passageway between other body sleeve 24 and plunger assembly inner sleeve 50 in a lower portion of the instrument. From this location further downward in the instrument fluid communication is through plug 62 and plug 64. These other connections to the fluid circuitry are described below in conjunction with the description of FIG. 2.

FIG. 3 illustrates plunger assembly 34 in its uppermost position. In this position the upward motion is limited by a limit stop shoulder 73 on the lower end of plunger assembly outer sleeve 48. When the plunger assembly is in this uppermost position then upper reservoir chamber 68 contains its maximum quantity of hydraulic fluid. As drilling mud begins to flow through the drill string the choke on tubular segment 36 creates the pressure differential needed to create a downwardly directed fluid force to overcome the upward bias of spring 58 thereby displacing plunger assembly 34 in the downward direction or telescopically moving it between its extended position and a telescopically retracted position.

During this downward motion mud flows through the interior of tubular segment 36, over vane 42 to the zone surrounding plunger mid body segment 40 then through an annular drilling fluid flow passage 74 between the interior of outer body sleeve 20 and the exterior of plunger assembly outer sleeve 48 and and the exterior of fixed inner sleeve 28. The mud exits this assembly between spaced apart fin-brace members 26 into another annular cavity 75 around other body sleeve 24 within drill collar 12. As the plunger assembly moves between the extended position and the retracted position, seal 30 maintains the fluid tight seal integrity of upper reservoir as the volume of chamber 68 is reduced while hydraulic power fluid flows in annular hydraulic fluid passageway 70 into other portions of the hydraulic system of the instrument.

Referring to FIG. 5, the instrument is illustrated with plunger assembly 34 displaced to its fully telescopically retracted location. In this position the lower extent of movement is limited by the upper end of fixed inner sleeve 28 contacting the lower surface of plunger assembly body coupler 46. As plunger assembly 34 reaches this fully retracted position the temporary occlusion created by choke 39 in tubular segment 36 in sleeve 20 is opened. This occurs as seal ring 38 moves downward beyond the lower end of one segment of sleeve 20 where it joins larger internal diameter segment of this outer body sleeve 20. When the plunger assembly is positioned as shown in FIG. 5 the mud pressure drop across the plunger assembly is substantially reduced from that present when it is in an extended position. Mud flow through drill collar 12 is substantially unrestricted when the instrument is positioned as shown in FIG. 5. As a result of this the measurement while drilling instrument does not dissipate any significant energy from the mud flow stream so this energy can be transmitted to the drill bit and for mud displacement.

It is to be noted that the plunger assembly remains in this telescopically retracted position so long as the drilling mud is continuing to be pumped through the drill string in a quantity sufficient to provide continuing downwardly directed force on the plunger assembly to retain it in this position. Normally in drilling operations this would be the period during which rotary drilling continues as the borehole is deepened by an amount equivalent to substantially one joint of drill pipe. When this step in the drilling procedure has been accomplished then the drilling mud flow is stopped temporarily. During the pause in mud flow, spring 58 urges plunger assembly 34 from the compressed and retracted position shown in FIG. 5 to the extended position shown in FIG. 3.

FIG. 2 illustrates schematically the hydraulic system of the downhole measurement while drilling instrument in which the improved hydraulic power unit of this invention is utilized in conjunction therewith. Mud flow through choke ring 39 displaces plunger assembly 34 in the downward direction which in turn reduces the volume of the upper hydraulic power fluid reservoir 68. Flow from the variable volume hydraulic chamber 68 passes through check valve 80 and into a two position control valve 82.

Hydraulic fluid from check valve 80 passes through a hydraulic flow restrictor 84 into a lower reservoir 86. Fluid flow through hydraulic flow restrictor 84 insures that plunger assembly 34 will be movable to its retracted position after control valve 82 has completed its signal sequence or in the event of failure of control valve 82. Lower reservoir 86 functions as a hydraulic accumulator. Lower reservoir 86 is exposed to hydrostatic mud pressure from the annulus of the borehole acting on its floating piston 88 in opposition to the hydraulic fluid.

When plunger 92 is repeatedly inserted into choke 94 and then withdrawn, a sequence of pressure pulses are created in the mud flow stream thereby modulating the mud flow with pressure pulses. These pressure pulses are received at the earth's surface by receiving equipment in order to extract intelligence carrying data generated by the downhole instrument.

One connection from control valve 82 to actuator 90 is a conduit 89 to the cylinder thereof acting on the lower side of its piston. Another fluid line from actuator 90 to control valve 82 is through conduit 96 from the upper side of the actuator's piston to the other pair of ports of control valve 82.

Control valve 82 is a two position four port electrical servo actuated valve operable to control operation of a mud flow modulation device at the lower end portion of the instrument. This mud flow modulation device includes a piston and cylinder type actuator 90 operably connected to a modulating plunger 92. Modulating plunger 92 is movable to be temporarily placed within the opening of a mud flow modulating choke 94 in order to pressure modulate mud flowing in the drill string. In one operating position control valve 82 causes extension of the actuators piston and movement of plunger 92 into choke 94. In its other operating position control valve 82 causes retraction of this piston and removal of plunger 92 from choke 94.

Conduit 98 communicates between control valve 82 and the variable volume cavity of lower reservoir 86. Lower reservoir 86 is connected by a conduit 100 to a check valve 102 and from there via conduit 104 to upper reservoir 68 at its variable hydraulic chamber.

During downward motion of plunger assembly 34 hydraulic fluid is displaced from the upper or hydraulic power fluid reservoir and passed through control valve 82 for operation of signal actuator 90. The discharged or spent fluid from actuator 90 passes again through control valve 82 and into lower reservoir 86. Some of the hydraulic power fluid bypasses control 82 by flowing through hydraulic restrictor 84 and into lower reservoir 86.

When the operating condition of this downhole instrument changes and mud flow through the drill string is terminated, then plunger assembly 34 is displaced upward by spring 58. When this occurs the mud's hydrostatic pressure acting on floating piston 88 in lower reservoir 86 allows the hydraulic fluid to return to upper reservoir 68 through conduit 100, check valve 102 and conduit 104. This return places the instrument into a condition to operate upon subsequent resumption of mud flow through the drill string.

In the use and operation of the improved hydraulic power unit of this invention as described, it is clear the improved power unit has certain advantages over prior art constructions. This power unit provides for a smooth and unobstructed mud flow through the power unit as energy is extracted from the drilling fluid. No parts of the apparatus are constructed so as to create flow induced vibrations in any of the apparatus.

It is important to note that once the plunger assembly has moved to the end of its stroke, the mud flow restriction due to the plunger being in the mud flow stream at surface is minimized and the effective area of the flow stream is increased to provide an unobstructive mud flow through passageway 74 during the drilling operation. Thus, horse power expended to pump the drilling mud may be utilized at the drill bit (not shown) rather than across the measurement while drilling instrument 10.

Due to the erosive nature of drilling muds, it is to be noted that all surfaces in contact with the flowing mud are desirably provided of erosion resistant materials or materials which are surface treated to reduce fluid erosion. As examples, the choke 39 may be provided of tungsten carbide and the interior of the sleeve may be hard plated or coated. It is also noted that the power unit structure 14 as herein described is of rigid construction and less subject to vibration or bending than prior structures.

Although preferred specific embodiments of this invention have been described in detail in the preceding description this description is not intended to limit the invention to the particular form or embodiments disclosed herein since they are to be recognized as illustrative rather than restrictive and it would be obvious to those skilled in the art that the invention is not so limited. For example the power unit is described as being an element in a downhole measurement while drilling apparatus whereas it could be incorporated into other downhole well apparatus where hydrualic fluid power is needed for a period following initiation of the drilling fluid flow through the drill string. Also the hydraulic power unit could be used to provide hydraulic power fluid for an actuator of a design other than the piston and cylinder actuator described herein.

Thus the invention is declared to cover all changes and modifications of the specific example of the invention herein disclosed for purposes of illustration which does not constitute departures from the spirit and scope of the invention.

The embodiments of the invention in which an exclusive property or privilege is claimed are defined as follows:

1. In a measurement while drilling system having a drill string mounted downhole instrument including a heading and inclination sensing instrument, and an associated hydraulically powered mud modulating device contained within an instrument drill collar of the drill string, an improved hydraulic powered unit therefore, comprising:

(a) a outer body sleeve ridigly and sealably mounted in said instrument drill collar;

(b) a rigidly mounted fixed inner sleeve connected to said outer body sleeve in concentric relation thereto;

(c) a longitudinally, movable plunger assembly having inner and outer sleeve members concentrically and telescopically mounted with said fixed inner sleeve forming a hydraulic power fluid reservoir with said fixed inner sleeve and also forming a drilling fluid flow passage with said outer body sleeve, said plunger assembly being movable between a telescopically extended position toward a telescopically retracted position to provide hydraulic power fluid to said mud modulating device; and (d) said plunger assembly includes at the upper end thereof a tubular segment sealably and slidably mounted within said outer body sleeve and having an occlusion therein operable to create a pressure differential in the mud flow through said hydraulic power unit while said plunger assembly is in a position other than in said retracted position.

2. The apparatus of claim 1, wherein:

said tubular segment occlusion includes an annular choke mounted therein and placed in the drill string mud flow and operable to create a fluid pressure differential across said tubular segment creating a force on said plunger assembly to urge said plunger assembly toward said telescopically retracted position.

3. The apparatus of claim 2, wherein:

(a) said plunger assembly has a slidable fluid seal connection with said fixed inner sleeve forming a movable seal of said hydraulic power fluid reservoir;

(b) said hydraulic power fluid reservoir includes an annular main chamber of variable volume and variable longitudinal dimension between said plunger assembly inner and outer sleeve members and a smaller annular chamber between said plunger assembly inner member and the interior of said fixed inner sleeve; and (c) said smaller annular chamber being connected in fluid communication with said hydraulically powered mud modulating device.

4. The apparatus of claim 3, wherein:

(a) said plunger assembly includes a spring biased between a movable element of said plunger assembly and a fixed portion of said instrument to urge said plunger assembly upward in opposition to mud flow downward through said drill string;

(b) said plunger assembly tubular segment is mounted on a central body segment upstream thereof by a rigid supporting vane member such that mud flow from said tubular segment is directed into an annular mud flow chamber segment around said central body segment within said outer body sleeve; and (c) a plurality of spaced apart supporting members between said outer body sleeve and said fixed inner sleeve form an outlet of said mud flow chamber and support said outer body sleeve in a fixed and concentric spaced relation to said fixed inner sleeve.

5. The apparatus of claim 3, wherein:

(a) said hydraulic chamber power fluid reservoir is connected in fluid communication with a hydraulic circuit control valve that is in turn connected in fluid communication with said mud modulating device and operable to actuate said mud modulating device for pressure pulse modulation of said mud; and (b) said hydraulic power fluid reservoir chamber is also in fluid communication with a spent hydraulic reservoir operable to accumulate spent hydraulic fluid from said hydraulic circuit at a hydrostatic pressure substantially equivalent to static pressure within said drill collar.

6. The apparatus of claim 1, wherein:

(a) said hydraulic power fluid reservoir has a variable volume hydraulic chamber contained therein variable between an enlarged volume with said plunger assembly being in said telescopically extended position and a reduced volume with said plunger assembly being in said telescopically retracted position; and (b) a mud flow pressure differential creating choke mounted with said plunger assembly operable to create a downwardly directed pressure resultant force on said plunger assembly for urging said plunger assembly toward said telescopically retracted position during periods of mud flow through said drillstring.

7. A measurement while drilling instrument, comprising:

(a) a drill collar mountable within the drill string of a rotary earth borehole drilling apparatus;

(b) a drilling parameter sensing instrument mounted in said drill collar for sensing at least one geophysical parameter;

(c) a data handling apparatus operably connected to said sensing instrument for processing data therefrom and producing data transmittable to receiving equipment at the earth's surface;

(d) a mud pressure pulse modulator and transmitter apparatus operably connected to said data handling apparatus for transmitting said data to the earth's surface through pressure pulsations of the mud flow stream;

(e) a hyraulic circuit operably connected to said mud pressure modulating and transmitting apparatus to provide hydraulic operating power therefor;

(f) a hydraulic power apparatus operably connected to said hydraulic circuit including a plunger assembly longitudinally movably mounted in said drill collar and being exposed to driling mud, and a hydraulic power fluid reservoir in said plunger assembly, said plunger assembly being longitudinally movable from an extended position to a retracted position due to forces of said drilling mud;

(g) said plunger assembly having a choke at an upper end portion thereof operable to pass the mud flow therethrough and create a pressure force downward on said plunger assembly for affecting downward movement thereof (h) said plunger assembly includes a tubular segment mounted on the upper end portion thereof with a fluid choke mounted therein; and (i) said tubular segment having a peripheral seal therearound providing a fluid tight seal between the exterior of said tubular segment and the interior of an associated outer body sleeve and being slidably movable longitudinally therein to provide continuous sealing upon motion of said plunger assembly between extended and retracted positions thereof.

8. The measurement while drilling instrument of claim 7, wherein:

(a) said hydraulic power fluid reservoir includes a variable volume hydraulic power fluid chamber in said plunger assembly operably connected to said hydraulic circuit; and (b) said variable volume hydraulic chamber being formed between overlapping telescopic elements of said plunger assembly and arranged for maximum volume with said plunger assembly in an uppermost extended position, and minimum volume with said plunger assembly in a lowermost retracted position.

9. The measuring while drilling instrument of claim 7, wherein said plunger assembly has inner and outer sleeve members concentrically and telescopically mounted on opposite sides of a fixed inner body sleeve thereby forming said variable volume hydraulic chamber between said inner sleeve, said outer sleeve and one end portion of said fixed sleeve; and said variable volume hydraulic chamber being connected in fluid communication with said hydraulic circuit by an annular passageway between said inner sleeve and said fixed inner body sleeve.

10. In a downhole measurement while drilling system having a hydraulically powered mud modulating device contained within an instrument drill collar of the drill string, an improved hydraulic powered unit therefore, comprising:

(a) an outer body sleeve rigidly and sealably mounted in said instrument drill collar;

(b) a rigidly mounted fixed inner sleeve connected in concentric relation to said outer body sleeve;

(c) a longitudinally, movable plunger assembly having inner and outer sleeve members concentrically and telescopically mounted with said fixed inner sleeve forming a hydraulic power fluid reservoir with said fixed inner sleeve and also forming a drilling fluid flow passage with said outer body sleeve, said plunger assembly being movable between a telescopically extended position toward a telescopically retracted position to provide hydraulic power fluid to said mud modulating device;

(d) a tubular segment included with the upper end of said plunger assembly and sealably and slidably mounted within said body sleeve;

(e) flow choke means mounted within said tubular segment for creating a fluid pressure differential across said plunger assembly responsive to drilling mud flow through said drill string and thereby creating a force operable to move said plunger assembly toward said telescopically retracted position; and (f) said body sleeve and said inner sleeve being formed operable for creating a maximum of said fluid pressure differential across said plunger assembly during movement of said plunger assembly toward said telescopically retracted position with said fluid pressure becoming small when said plunger assembly reaches completely said telescopically retracted position.

11. The apparatus of claim 10, wherein:

(a) said plunger assembly includes a spring biased between a movable element of said plunger assembly and a fixed portion of said instrument to urge said plunger assembly upward in opposition to mud flow downward through said drillstring;

(b) said plunger assembly tubular segment is mounted on a central body segment upstream thereof by a rigid supporting vane member such that mud flow from said tubular segment is directed into an annular mud flow chamber segment around said central body segment within said outer body sleeve; and (c) a plurality of spaced apart supporting members between said outer body sleeve and said fixed inner sleeve form an outlet of said mud flow chamber and support said outer body sleeve in a fixed and concentric spaced relation to said fixed inner sleeve.

* * * * *